United States Patent [19]

McCain

[11] Patent Number: 5,056,452

[45] Date of Patent: Oct. 15, 1991

[54] FLOATING DOCK CONNECTION

[76] Inventor: Charles R. McCain, 9060 Old Albion Rd., Girard, Pa. 16417

[21] Appl. No.: 572,699

[22] Filed: Aug. 27, 1990

[51] Int. Cl.[5] ..... B63B 35/72

[52] U.S. Cl. ..... 114/263; 405/219

[58] Field of Search ..... 114/230, 263, 264, 266, 114/267, 256, 258; 405/219, 220

[56] References Cited

U.S. PATENT DOCUMENTS

| | | | |
|---|---|---|---|
| 3,455,115 | 7/1969 | Watts et al. | 61/48 |
| 3,492,825 | 2/1970 | Pearson | 114/263 |
| 3,977,030 | 8/1976 | Ringdal | 114/263 |
| 4,126,006 | 11/1978 | Lewis | 405/220 |
| 4,311,413 | 1/1982 | Sluys | 405/219 |
| 4,462,000 | 7/1984 | Gottlieb et al. | 330/51 |
| 4,505,619 | 3/1985 | Sargent | 114/263 |
| 4,656,961 | 4/1987 | Hellkamp | 114/230 |
| 4,660,495 | 4/1987 | Thompson | 114/263 |
| 4,683,833 | 8/1987 | Meriwether | 114/267 |
| 4,928,616 | 5/1990 | Robinshaw et al. | 114/267 |

FOREIGN PATENT DOCUMENTS

| | | |
|---|---|---|
| 341281 | 8/1936 | Italy . |

*Primary Examiner*—Sherman Basinger
*Assistant Examiner*—Stephen P. Avila
*Attorney, Agent, or Firm*—Charles L. Lovercheck; Wayne L. Lovercheck; Dale Lovercheck

[57] ABSTRACT

A floating dock having a plurality of spaced parallel finger floats disposed in spaced parallel relation to one another. Spaced headwalk float sections each having a first end and a second end and disposed in alignment with one another and perpendicular to said finger floats and between said finger floats. The first end of each headwalk float being hinged to a finger float to swing about a horizontal axis. Each said second end of each said headwalk float being attached to a finger float by means of a vertically extending pin means.

13 Claims, 4 Drawing Sheets

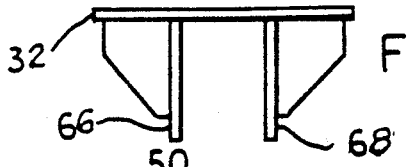
FIG. 13
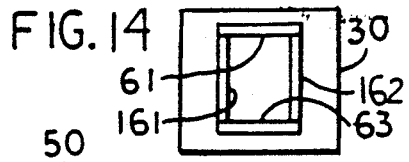
FIG. 14
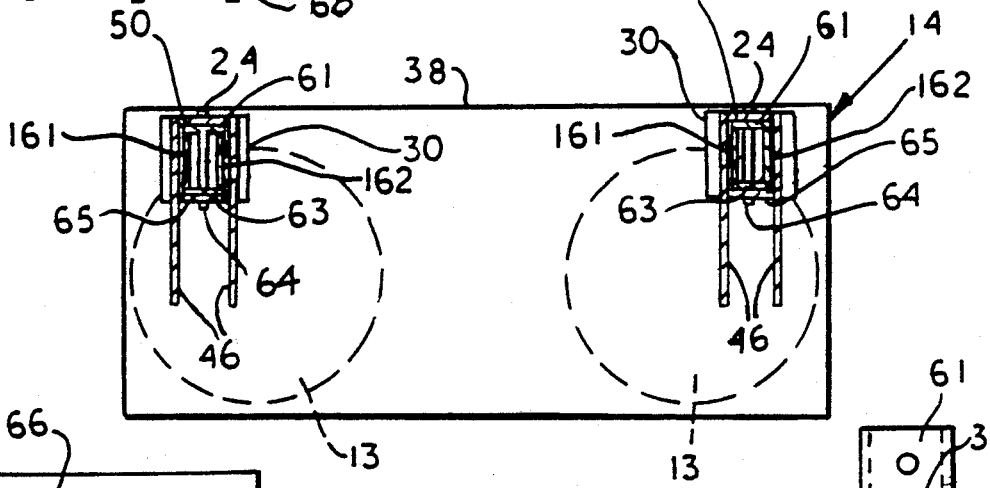
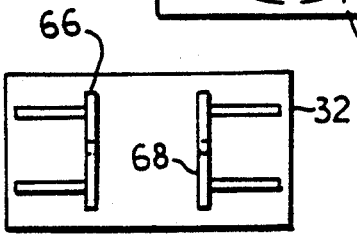
FIG. 5
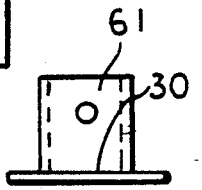
FIG. 15
FIG. 12
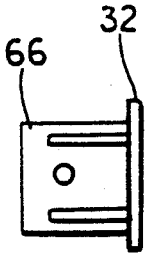
FIG. 11
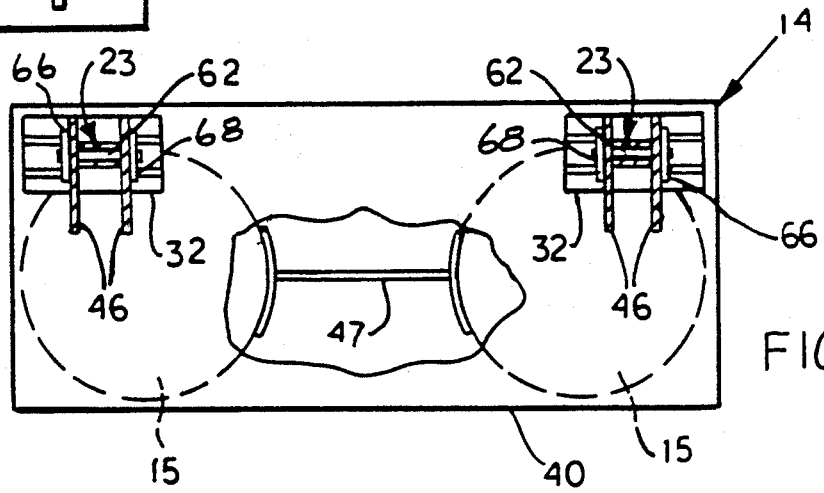
FIG. 6
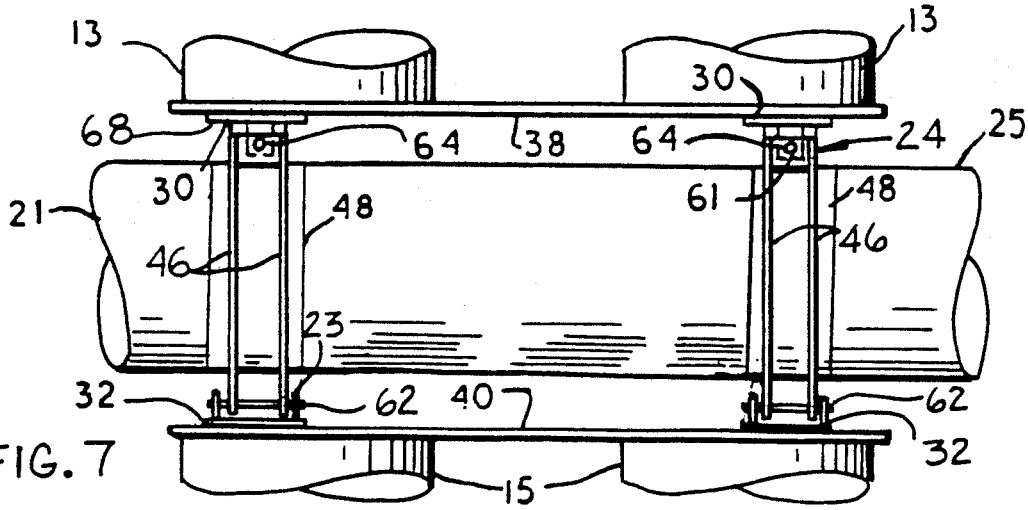
FIG. 7

FLOATING DOCK CONNECTION

BACKGROUND OF THE INVENTION

Floating dock systems, such as are in general use at the present time, are generally made up of two or more individual dock sections which are hinged to one another to permit each headwalk section to swing vertically relative to the headwalk section adjacent it to accommodate the various wave conditions of the water on which the dock is floating. The individual dock sections are provided with suitable airtight, buoyant float drums, bodies of foam or the like. Previously, hinged inter connections of dock sections of such floating docks had generally been accomplished by simple pivoting of one section to another to pivot about a single axis only. This did not ideally accommodate the dock sections to the usual water conditions. Applicant has discovered that by providing finger float sections hinged between two adjacent headwalk sections and having one float section pinned about a vertical axis and the corresponding float on the opposite side hinged about a horizontal axis, a more stable and practical arrangement of dock sections can be accomplished.

SUMMARY OF THE INVENTION

This invention relates in general to floating docks and more particularly to a hinge connection for interconnecting adjacent dock sections to permit vertical swinging movement as well as horizontal swinging movement between the sections.

The present invention incorporates a new and improved floating dock construction having an improved hinge connector for the dock sections which overcomes the previous problems and others and provides a section that will float more smoothly on rough water.

In accordance with one aspect of the invention, hinge sections are provided between finger sections and headwalk sections where each headwalk section has one of its ends hinged to the adjacent finger section about a horizontal axis and the other end is pinned to a finger section about vertical axes.

The principal object of the invention is to provide an improved hinge connection between adjoining spaced sections of a dock which is simple in construction and economical to manufacture and simple and efficient to use.

Another object of the invention is to provide a floating dock having adjoining space dock sections pivotally interconnected and other dock sections pivotally connected for vertical pivotal movement and flexure about horizontal axes.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWINGS

FIG. 5 is a cross-sectional view taken on line 5—5 of FIG. 2 through a vertical pin connection.

FIG. 6 is a cross-sectional view taken on line 6—6 of FIG. 2 through a horizontal hinge pin connection.

FIG. 7 is a top view of the floats with the platform removed.

FIG. 11 is a partial side view of FIG. 6.

FIG. 12 is a partial front view of FIG. 6.

FIG. 13 is a partial view of FIG. 6.

FIG. 14 is a partial front view of FIG. 5.

FIG. 15 is a partial top view of FIG. 5.

DESCRIPTION OF THE PREFERRED EMBODIMENT

Figure 1:
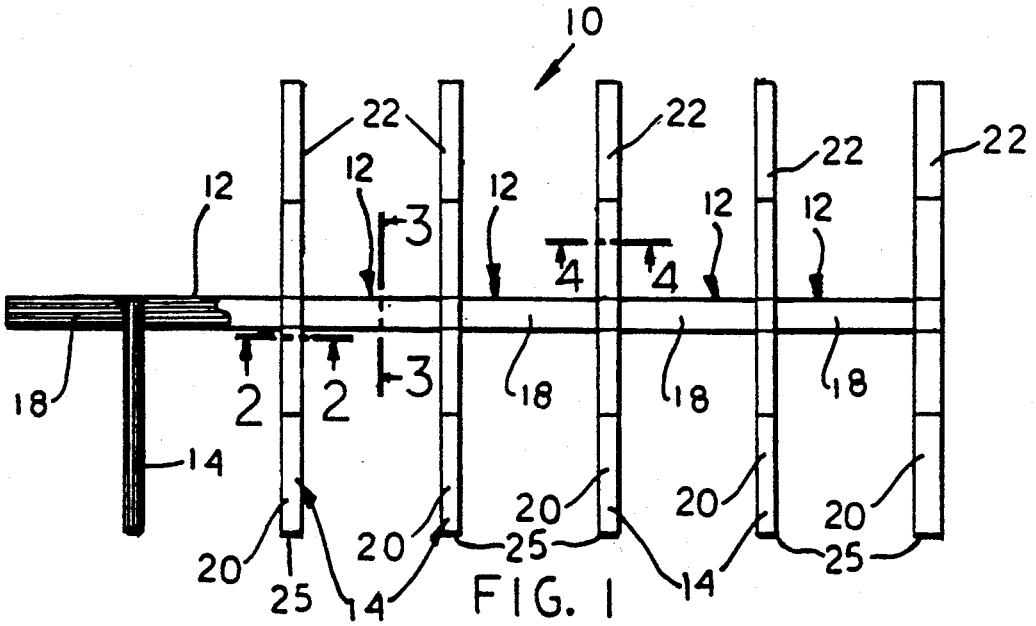
FIG. 1 is a top view of a floating dock according to the invention.
Figure 2:
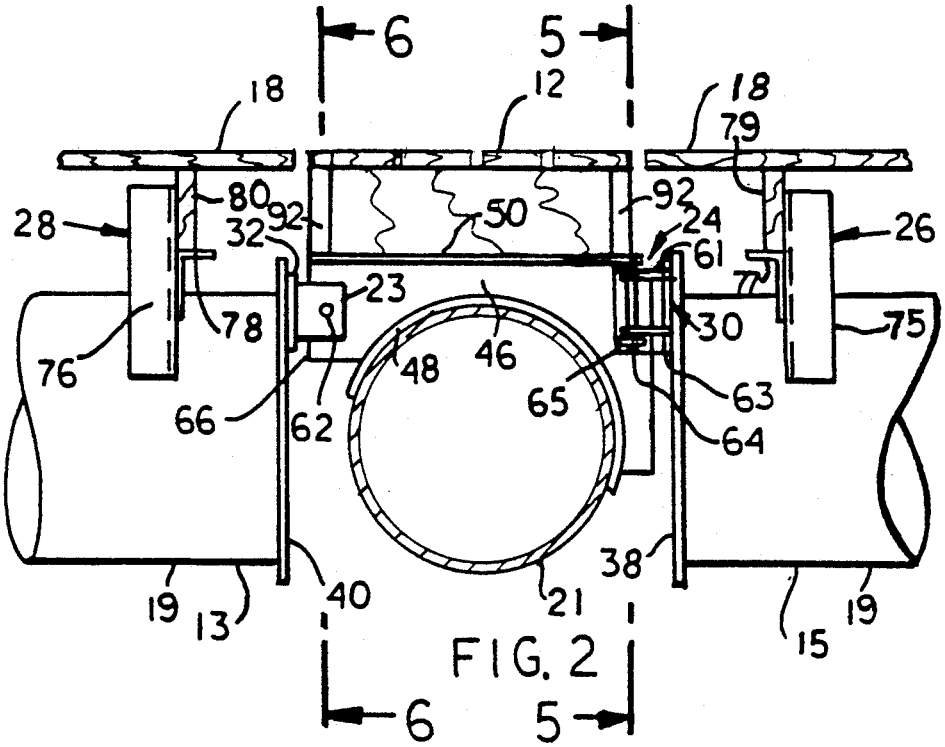
FIG. 2 is a cross-sectional view taken on Line 2—2 of FIG. 1.
Figure 3:
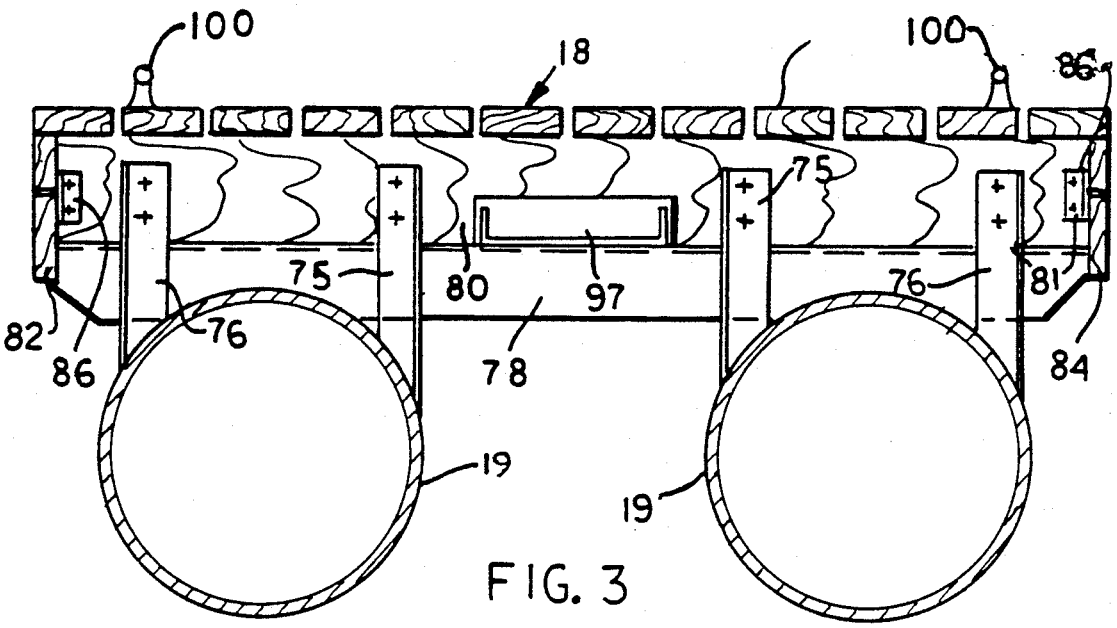
FIG. 3 is a cross-sectional view taken on Line 3—3 of FIG. 1.
Figure 4:
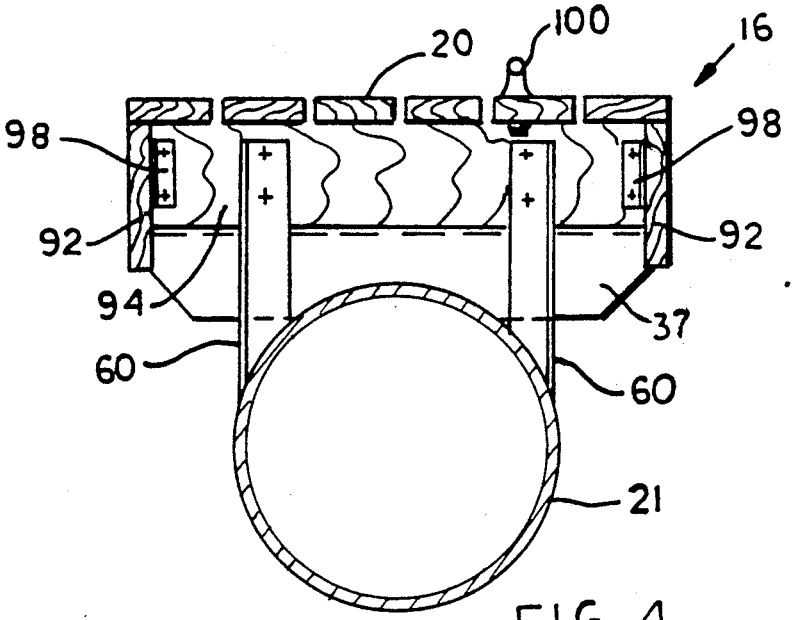
FIG. 4 is a cross-sectional view taken on Line 4—4 of FIG. 1.
Figure 8:
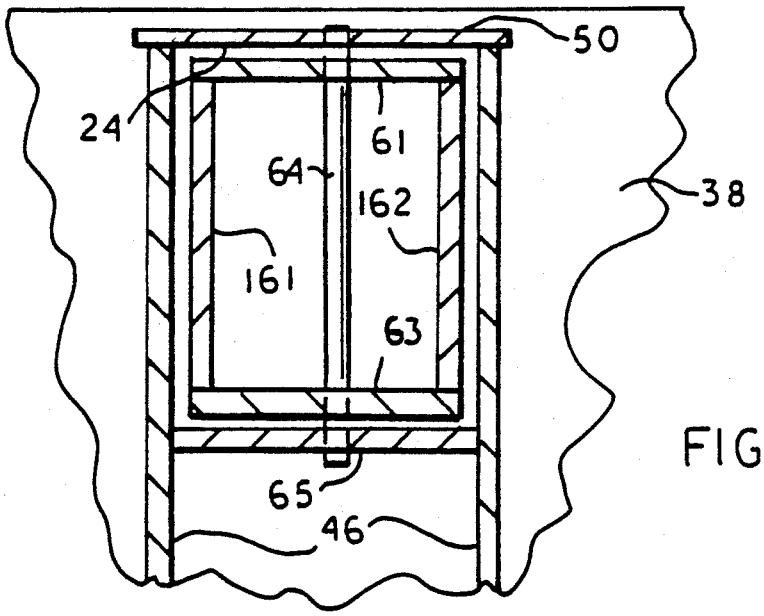
FIG. 8 is an enlarged view of a part of FIG. 5.
Figure 9:
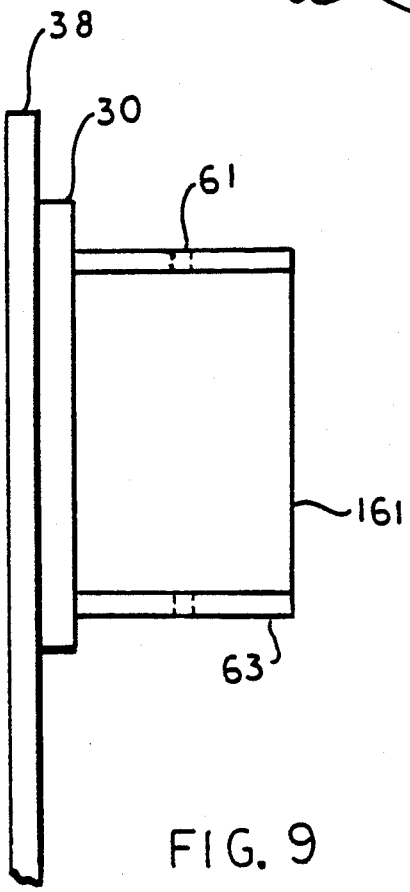
FIG. 9 is an enlarged partial view of FIG. 2.
Figure 10:
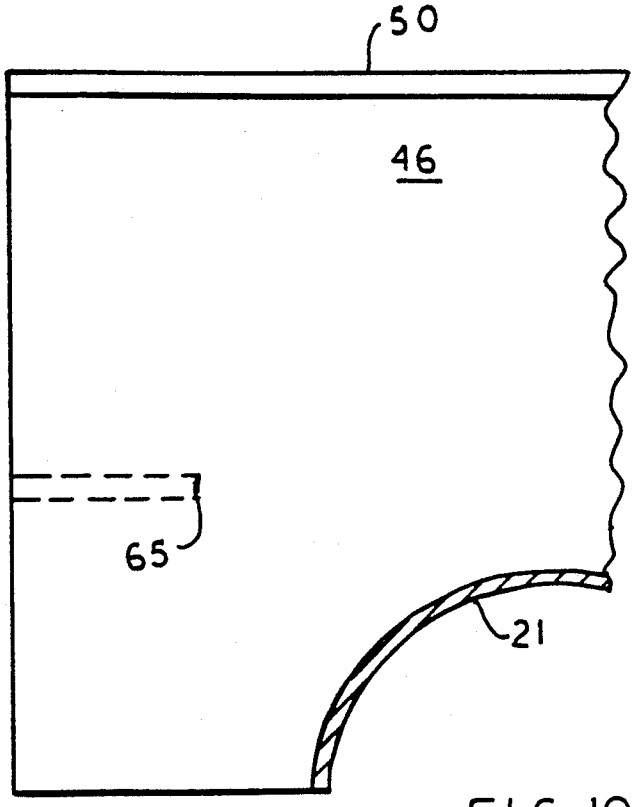
FIG. 10 is an enlarged partial view of FIG. 2.

Floating dock 10 is made up of several elongated headwalk sections 12 arranged in spaced aligned relation to one another. The number of headwalk sections 12 will be determined by the number of boats to be moored. Floating dock 10 includes several finger sections 14 which are arranged perpendicular to headwalk sections 12 and finger platform 20. Each headwalk section 12 has one headwalk platform 18 and two headwalk floats 19. Headwalk sections 12 are arranged in aligned relation to one another and perpendicular to finger sections 14. Headwalk platforms 18 could be made of wood, steel or any other suitable material.

Finger floats 21 are each made of single integral hollow cylinder having first end 22 and second end 25. Headwalk floats 19 each have first end 13 and second end 15. Headwalk floats 19 may be be made in form of pairs of elongated hollow steel cylinders of equal length disposed in alignment with one another. Headwalk floats 19 are so arranged that first end 13 of each headwalk float 19 is adjacent second end 15 of headwalk float 19 adjacent it with space therebetween. First ends 13 of headwalk floats 19 are closed at their ends and held together by laterally extending first end plates 40. Second ends 15 of headwalk floats 19 are closed at their ends and held together by laterally extending second end plates 38. First end plates 40 and second end plates 38 are arranged in vertical planes and function as supports for horizontal hinges 23 and laterally spaced connections 24. Headwalk floats 19 are further held together at intermediate positions by braces 47.

Two laterally spaced horizontal hinges 23 are made up of spaced pairs of lugs 66 and 68. Lugs 66 and 68 are welded to pairs of sole plates 32. Sole plates 32 are welded to first end plates 40. The end of yokes 46 are received between lugs 66 and 68. Pins 62 pass through lugs 66 and 68 and through the ends of yokes 46, forming a hinge. Headwalk sections 12 can swing about pins 62. Yokes 46 are welded to plates 48 which are welded to a particular finger float 21.

Laterally spaced connections 24 connect first ends 13 of headwalk floats 19 to finger sections 14. Laterally spaced connections 24 are made up of rectangular box sections which are made up of plates 61, 63, 161 and 162, which are welded together and also welded to plate 30, which is welded to second end plate 38. Plates 61, 63, 161 and 162 are received inside the rectangular space between yokes 46 and vertically spaced plates 50 and 65. Vertically spaced plates 50 are welded to the upper edge of yokes 46. Vertically spaced plates 65 have their ends welded to yokes 46. Vertically extending pins 64 extend through holes in vertically spaced plates 50 and 65, which are aligned with holes in plates 61 and 63, holding first ends 15 of headwalk floats 19 to finger sections 14.

Headwalk platforms 18 are supported on headwalk floats 19 adjacent their ends by first support means 26 and second support means 28. First support means 26 is made up of studs 75 and beams 77 which support lateral joists 79. Second support means 28 are made up of studs 76, beams 78 and laterally extending joists 80. Joists 79 and 80 rest on beams 77 and 78. Beams 77 and 78 are welded to the upper ends of angular studs 75 and 76 respectively. Headwalk platforms 18 have longitudinal side boards 82 and 84 attached to lateral joists 79 and 80 by clips 86.

Finger platforms 20 are supported on finger sections 14 by joists 94 and angle beams 37. Angle beams 37 are welded to studs 60. Sideboards 92 are attached to joists 94 by clips 98. Mooring cleats 100 are attached to headwalk platforms 18 and finger platforms 20 to attach lines for attaching to boats. Utility tray 97 is provided below headwalk platforms 18.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privledge is claimed are defined as follows:

1. A floating dock comprising a plurality of elongated finger sections each comprising a single relatively rigid integral member having a first end, a second end and an intermediated part and disposed in spaced parallel relation to one another with spaces therebetween, a plurality of headwalk sections each comprising two parallel float members, each said headwalk section having a first end and a second end, each said headwalk section having a first end disposed in alignment with one another and perpendicular to said finger sections, each said headwalk section being disposed in a said space between two adjacent said finger sections, laterally spaced first horizontal hinge means swingably connecting each said first end of each said headwalk section to a said intermediate part of said finger section to swing about a horizontal axis.

2. The floating dock recited in claim 1 wherein each said headwalk section comprises a first end plate fixed to one end of said headwalk float and rigidly connecting two parallel said headwalk floats together.

3. The floating dock recited in claim 2 wherein each said headwalk section comprises a headwalk platform and first support means supporting said headwalk platform on two said headwalk floats.

4. The floating dock recited in claim 3 wherein said first support means supporting said headwalk platform on each said headwalk section comprises a laterally extending beam supported on said headwalk floats, said laterally extending beam adjacent said first end plate and adjacent said second end plate, laterally extending joist supported on said beam supporting said headwalk platform.

5. The floating dock recited in claim 4 wherein said finger floats each have a finger platform and a stud supporting said finger platform on each said finger float.

6. The floating dock recited in claim 5 wherein said finger floats each have a first end, a second end and an intermediate part, two spaced plate-like yokes supported on said intermediate part of said finger float and disposed in vertical planes, spaced joists supported on said yokes supporting each said finger platform.

7. The floating dock recited in claim 6 wherein each said headwalk float comprises a hollow cylinder having open ends and plates closing each said open end.

8. The floating dock recited in claim 7 wherein each said horizontal hinge means comprises two spaced lugs fixed to a said first end plate, said yokes being disposed between each said spaced lugs, a horizontal hinge pin extending through each said yoke and each said lug whereby said first end of each said headwalk float can swing about said horizontal hinge pin relative to said finger float adjacent thereto.

9. A floating dock comprising a plurality of elongated first finger sections and a plurality of second finger sections disposed in spaced parallel relation to one another with spaces between said first finger sections and said second finger sections, a plurality of headwalk sections disposed in alignment with one another, each said headwalk section being disposed in said space between two adjacent said first finger sections, first horizontal hinge means swingably connecting some of said headwalk sections to said first finger sections to swing about a horizontal axis, laterally spaced connecting means connecting each said headwalk section to some of said second finger sections, each said finger section comprises a single integral finger float and, each said headwalk section comprises two parallel headwalk floats, each said headwalk section comprises a first end plate fixed to one end of said headwalk float and rigidly connecting two parallel said headwalk floats together, each said headwalk section comprises a headwalk platform and first support means supporting said headwalk platform on two said headwalk floats, said first support means supporting said headwalk platform on each said headwalk section comprises a laterally extending beam supported on said headwalk floats, said laterally extending beam adjacent said first end plate and adjacent said second end plate, laterally extending joists supported on said beam supporting said headwalk platform, said finger floats each have a finger platform and a stud supporting said finger platform on each said finger float, said finger floats each have a first end, a second end and an intermediate part, two spaced plate-like yokes supported on said intermediate part of said finger float and disposed in vertical planes, spaced joists supported on said yokes supporting each said finger platform, each said headwalk float comprises a hollow cylinder having open ends and plates closing each said open end, each said horizontal hinge means comprises two spaced lugs fixed to a said first end plate, said yokes being disposed between each said spaced lugs, a horizontal hinge pin extending through each said yoke and each said lug whereby said first end of each said headwalk float can swing about said horizontal hinge pin relative to said finger float adjacent thereto, each said yoke has two first vertically spaced lugs fixed to said second plate and two vertically spaced lugs fixed to said yokes adjacent a first end of said headwalk section, two horizontally spaced lugs fixed to said second end plate and received between said yokes, a vertically extending pin extending through each said first vertically spaced lugs and said second vertically spaced lugs whereby said second end of each said headwalk float is held to said finger float.

10. A floating dock comprising a plurality of relatively rigid elongated spaced laterally spaced parallel finger floats each having a first end, a second end and an intermediate part, a plurality of axially spaced aligned pairs of headwalk floats, each said pair of headwalk floats having a first end and a second end and being disposed between two said finger floats, a horizontal hinge connecting each said first end of each said pair of headwalk floats to said intermediate part of a said finger float to swing about a horizontal axis, laterally spaced vertical axis means connecting said second end of each said pair of headwalk floats to said intermediate part of a said finger float, each said finger float having a finger platform thereon, each said pair of headwalk floats having a headwalk platform supported thereon, each said pair of headwalk floats comprises two spaced parallel hollow cylinders.

11. The dock recited in claim 10 wherein said headwalk floats are in the form of hollow cylinders and said second end plates form an enclosure for the ends of said headwalk floats.

12. The dock recited in claim 10 wherein said laterally spaced connections connect said second end plates of each said headwalk section to said finger float.

13. A floating dock comprising a plurality of elongated spaced parallel finger floats each having a first end, a second end and an intermediate part, a plurality of spaced aligned pairs of headwalk floats, each said pair of headwalk floats having a first end and a second end and being disposed between two said finger floats, said horizontal hinge means comprising a horizontal hinge connecting each said first end of each said pair of headwalk floats to said intermediate part of said finger float about a horizontal axis, laterally spaced connections connecting said second end of each said pair of headwalk floats to said intermediate part of said finger float about a vertical axis, each said finger float has a finger platform thereon, each said pair of headwalk floats has a headwalk platform support thereon, each said pair of headwalk floats comprises two spaced parallel hollow cylinders, two said first ends of said headwalk floats are fixed to first end plates and two said second ends of said headwalk floats are fixed to second end plates, each said headwalk section comprises two said headwalk floats with a said headwalk platform, a plurality of said headwalk sections are disposed in spaced aligned position comprising said floating dock, said headwalk floats are in the form of hollow cylinders and said second end plates form an enclosure for the ends of said headwalk floats, said pairs of parallel headwalk floats are rigidly connected together, said laterally spaced connections connect said second end plates of each said headwalk section to said finger float, said laterally spaced connections comprise first plates fixed to said second end plates of each said headwalk section, a vertically extending pin extending through said first plates and through spaced plates on said yoke whereby said second end plates of said headwalk section are connected to said yokes of said headwalk section.

* * * * *